US006213177B1

(12) United States Patent
Kempe et al.

(10) Patent No.: US 6,213,177 B1
(45) Date of Patent: Apr. 10, 2001

(54) FEED WHEEL

(75) Inventors: Ron Kempe; Hans Kempe, both of Moolap (AU)

(73) Assignee: Kempe Project Engineers Pty Ltd, Moolap (AU)

( * ) Notice: Subject to any disclaimer, the term of this patent is extended or adjusted under 35 U.S.C. 154(b) by 0 days.

(21) Appl. No.: 09/369,019

(22) Filed: Aug. 6, 1999

(30) Foreign Application Priority Data

Jun. 23, 1999 (AU) ..... PQ1148/99

(51) Int. Cl.[7] ..... B27C 5/02

(52) U.S. Cl. ..... 144/248.4; 144/246.1; 144/248.7; 198/781.01; 198/781.02

(58) Field of Search ..... 198/780, 788, 198/835, 692, 722, 781.01; 144/246.1, 248.4, 248.5, 117.1, 248.7; 492/36, 45

(56) References Cited

U.S. PATENT DOCUMENTS 1,514,505 * 11/1924 Conklin ..... 144/248.7
1,652,756 * 12/1927 Bruce ..... 144/248.7
4,058,151 * 11/1977 Yonezu ..... 144/248.7
4,385,650 * 5/1983 Schmidt ..... 144/248.4
4,603,718 * 8/1986 Hutson ..... 144/246.1

* cited by examiner

*Primary Examiner*—W. Donald Bray
(74) *Attorney, Agent, or Firm*—Sughrue, Mion, Zinn, Macpeak & Seas, PLLC

(57) ABSTRACT

A feed wheel (24) for use in a wood working machine (10) in which the feed wheel is rotated while in driving engagement with a wood piece to drive the wood piece past a wood working element. The feed wheel is preferably driveable in one direction only and is freely rotatable in the direction opposite to that for feeding. The feed wheel is preferably formed of a hub part (40) and a rim part (38) which is separable from the hub part. The rim part includes teeth arranged to extend at a helix angle relative to the axis of the wheel and the teeth are preferably provided with a wear-resistant diamond layer for engaging the wood piece.

16 Claims, 12 Drawing Sheets

FIG 12
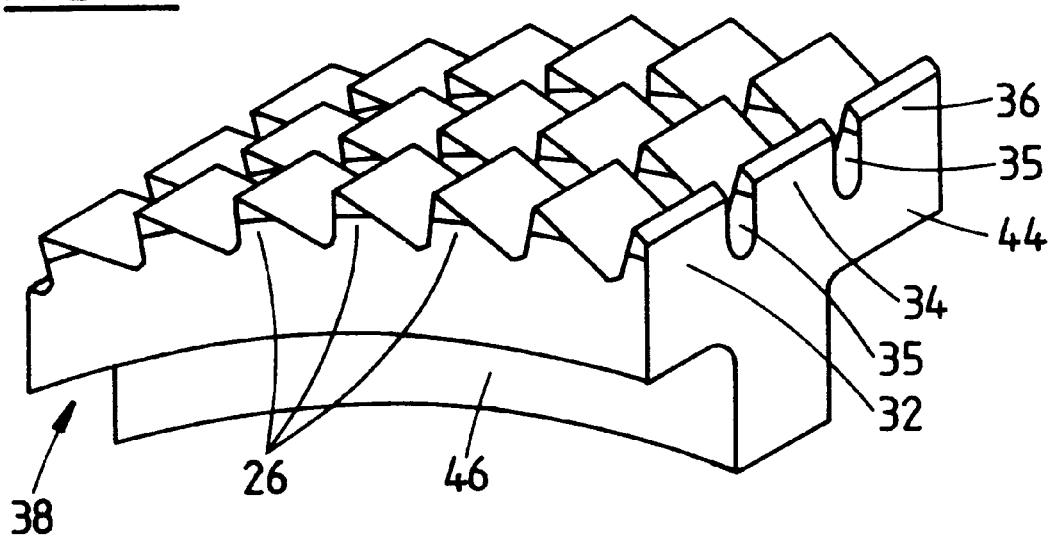
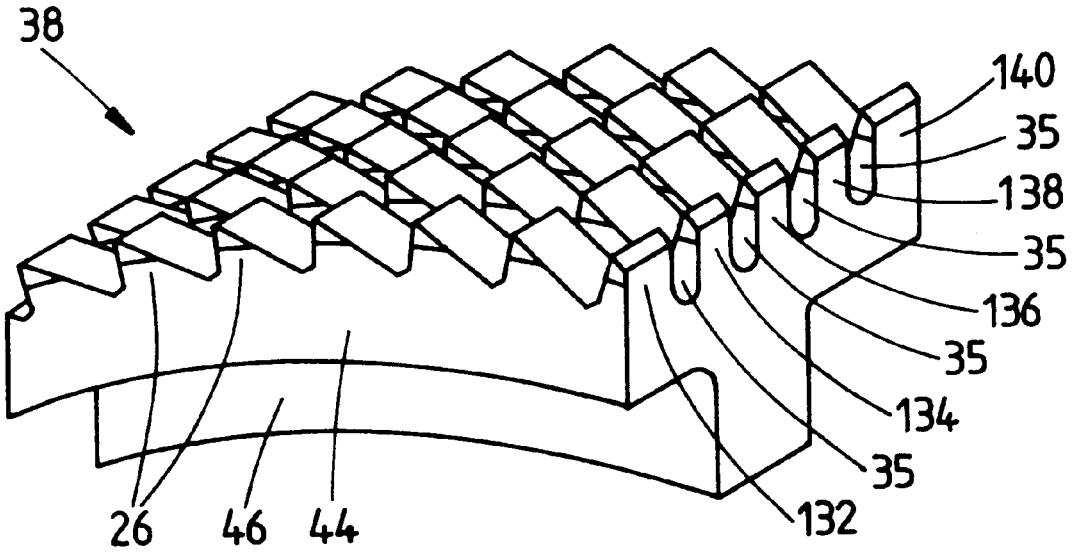
FIG 13

FEED WHEEL

FIELD OF THE INVENTION

This invention relates to a feed wheel particularly, but not exclusively, for use in a wood working machine.

SUMMARY OF THE INVENTION

In one aspect, the invention provides a feed wheel for use in a wood working machine in which the feed wheel is rotated while in driving engagement with the surface of a wood piece to drive the wood piece past a wood working element, for working the wood piece, the wheel having a periphery adapted, such as by the provision of teeth thereon, for driving engagement with the wood piece, and incorporating a one way drive device such that the feed wheel may be driven only in the direction for feeding of the wood piece, being freely rotatable in the direction opposite to that for feeding.

In another aspect, the invention provides a feed wheel for use in a wood working machine in which the feed wheel is rotated while in driving engagement with the surface of a wood piece to drive the wood piece past a wood working element, for working the wood piece, the wheel having a periphery adapted, such as by the provision of teeth thereon, for driving engagement with the wood piece, the feed wheel having a rim portion separable from the remainder thereof. By this, when the feed wheel periphery wears it may be replaced by fitting a new rim portion.

In another aspect, the invention provides a feed wheel for use in a wood working machine in which the feed wheel is rotated while in driving engagement with the surface of a wood piece to drive the wood piece past a wood working element, for working the wood piece, the wheel having a periphery adapted for driving engagement with the wood piece, the feed wheel having teeth around the circumference thereof, the teeth presenting a forward substantially radial face, and a trailing face which extends at an angle to the substantially radial face, such that the teeth are generally triangular in cross-sectional form, the teeth being arranged such that apices thereof, defined at the junction between the faces thereof, extend at a helix angle relative to the axis of the wheel. The aforementioned angle may be in the range of 15 to 25 degrees, such as for example substantially 20 degrees, and may be such that the apexes extend at the aforementioned angle either in a trailing or advancing direction with respect to the intended direction of rotation of the wheel. The angle presented between the trailing face of each tooth, and the substantially upright face of a succeeding tooth is in the range 58 to 62 degrees. The dimension of the substantially radial face of each tooth reckoned radially of the wheel is within the range of 4 to 7 mm, most preferably substantially 5 mm. The teeth may have one or more circumferential grooves.

The invention also provides a wood working machine, having a feed wheel according to the invention, and a method of forming a wear resistant diamond layer on a surface of the feed wheel.

BRIEF DESCRIPTION OF THE DRAWINGS

The invention is further described by way of example only with reference to the accompanying drawings in which;

FIGS. 12 and 13 are fragmentary views of segments of various other rim portions constructed in accordance with the invention;

DETAILED DESCRIPTION OF A PREFERRED EMBODIMENT

Figure 1:
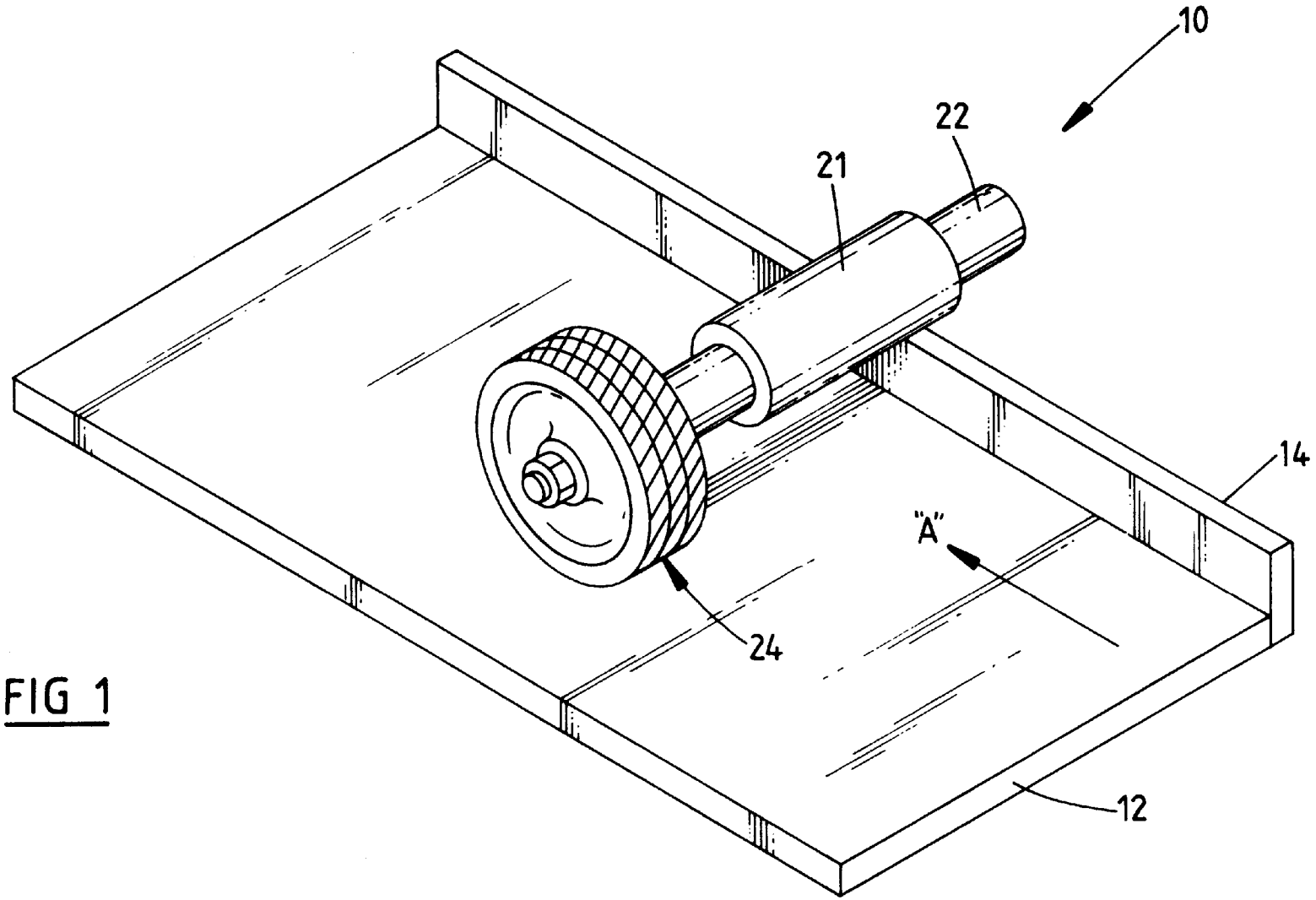
FIG. 1 is a diagrammatic perspective view of a wood working machine utilising a feed wheel constructed in accordance with the invention.
Figure 2:
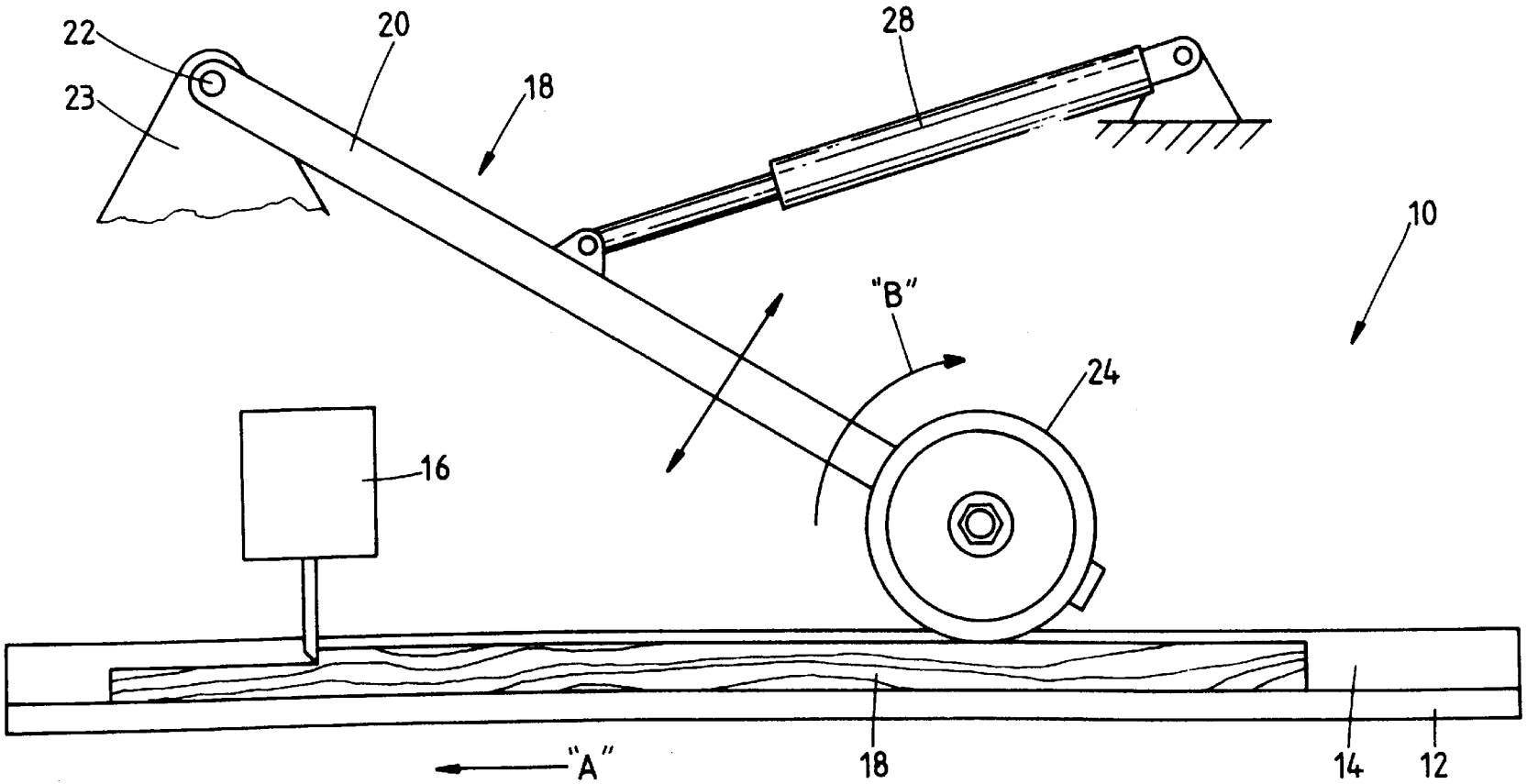
FIG. 2 is a diagrammatic side view of the machine of FIG. 1.
Figure 3:
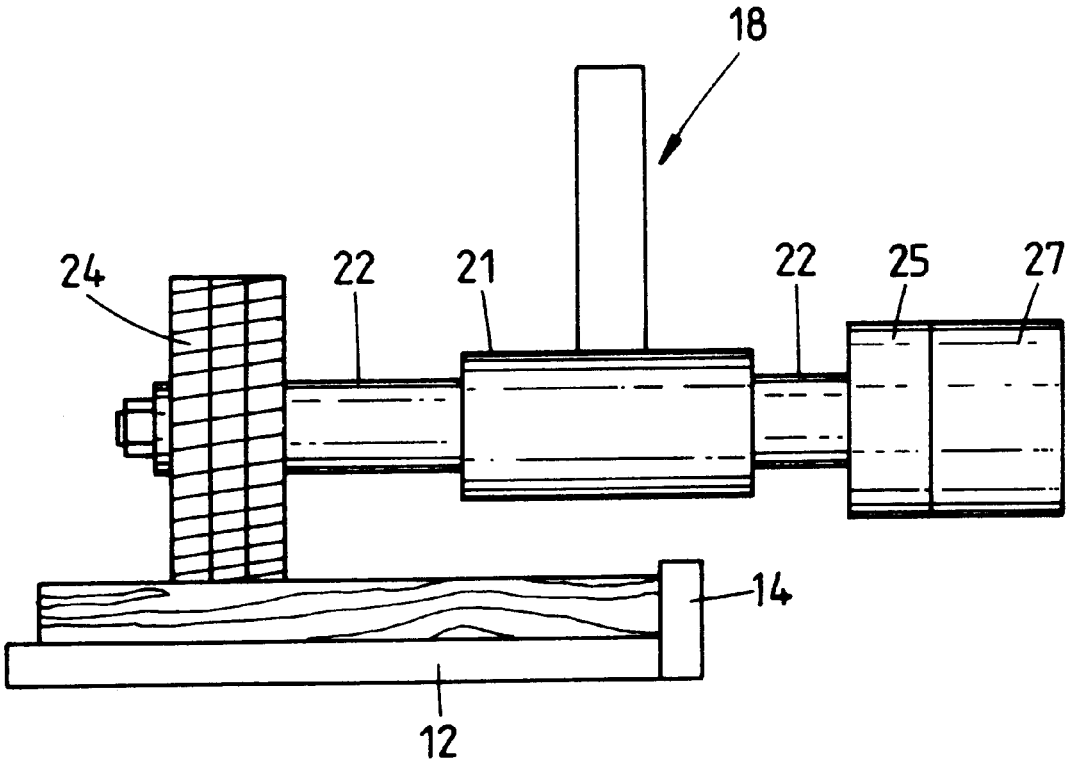
FIG. 3 is a diagrammatic end view of the machine of FIG. 1.

FIGS. 1 to 3 illustrate diagrammatically a wood working machine 10 having a machine bed 12, a side fence 14 and a machine head 16. In use, a wood piece 18 is positioned on the bed 12 adjacent the fence 14 and is advanced in the direction illustrated by the arrow "A" in FIG. 1 and FIG. 2 past the head 16 so that the wood piece is machined. The wood piece is normally held against the side fence 14 during this operation, for purposes of accurately aligning the wood piece with the head 16. The head 16 may for example be a milling cutter, a saw or the like.

In machines of the kind illustrated, it is customary to provide some mechanism for automatically advancing tile wood piece past the machine head. In the present instance, this mechanism, designated generally by reference numeral 18, includes an arm 20 pivotally connected at the location 22 to a fixed part 23 of the machine, so as to trail backwardly and downwardly from the location 22 to a location somewhat behind the location of the head 16. At its lower end, the arm 20 carries a bearing housing 21 which carries, for free rotation therewithin, a feed wheel shaft 22. At one side, over the machine bed 12, the shaft has affixed thereto a feed wheel 24. At the other side, the shaft 22 is affixed to a suitable drive means. By way of example only, in this case, the shaft is shown arranged for driving from an electric motor 27, via a gearbox 25.

The arm 20 is coupled to an extensible hydraulic ram 28 which is actuatable to cause the arm to be rotated about the location 22 from a position (not shown) at which the feed wheel 24 is well above the bed 12 to the position shown in FIGS. 2 and 3 at which it is lowered such that the periphery feed wheel 24 is pressed into engagement with the upper surface of a wood piece 18 which is to be fed through the machine. When in this condition, the feed wheel 24 may be rotated by operation of the motor 25 so as to cause the feed wheel to rotate in the direction indicated by the arrow "B" in FIG. 2, to frictionally engage the upper surface of the wood piece 18 to drive this in the direction "A" as described, for machining of the work piece.

Figure 5:
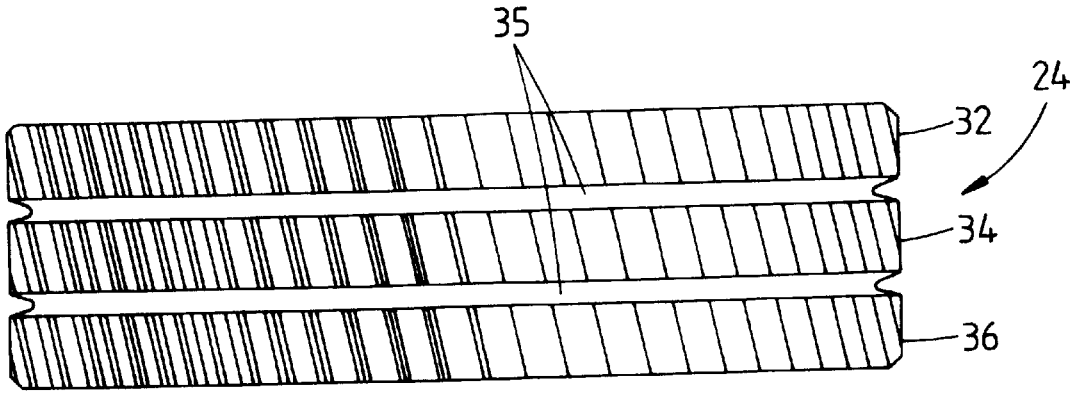
FIG. 5 is a top view of the feed wheel of FIG. 4.
Figure 4:
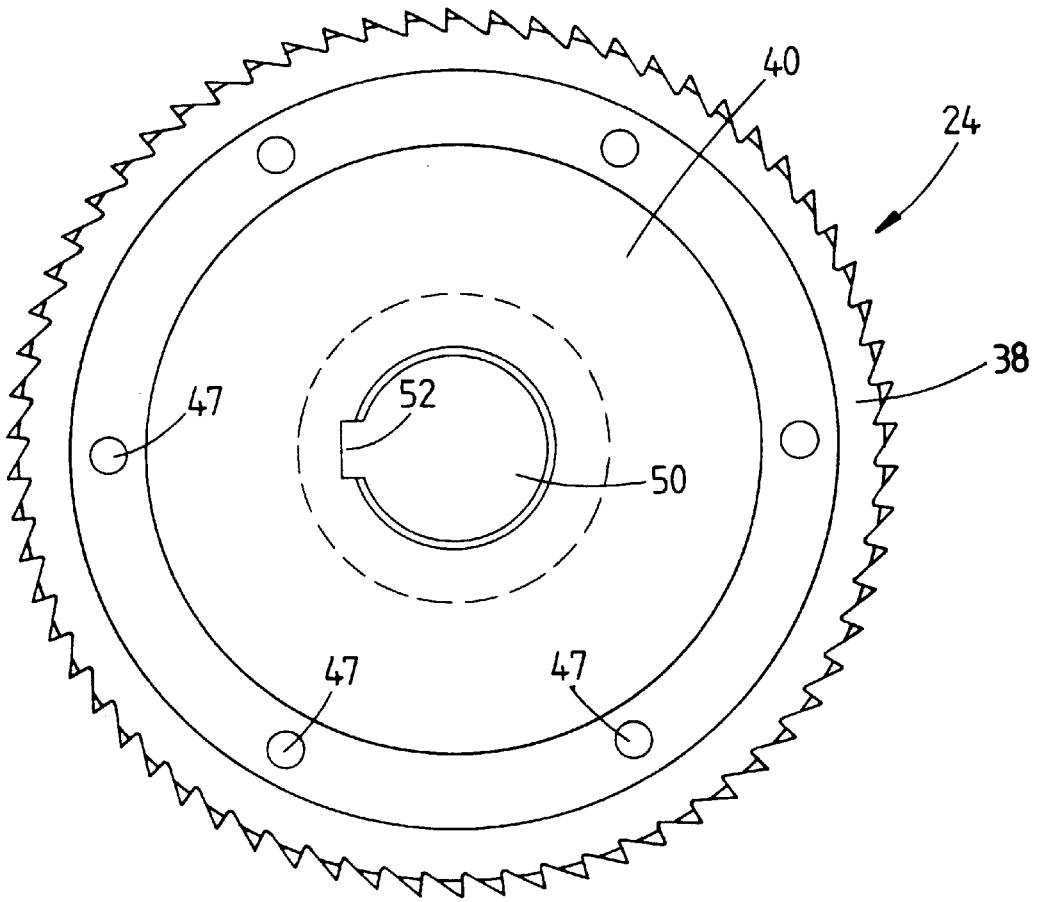
FIG. 4 is a side view of the feed wheel.
Figure 6:
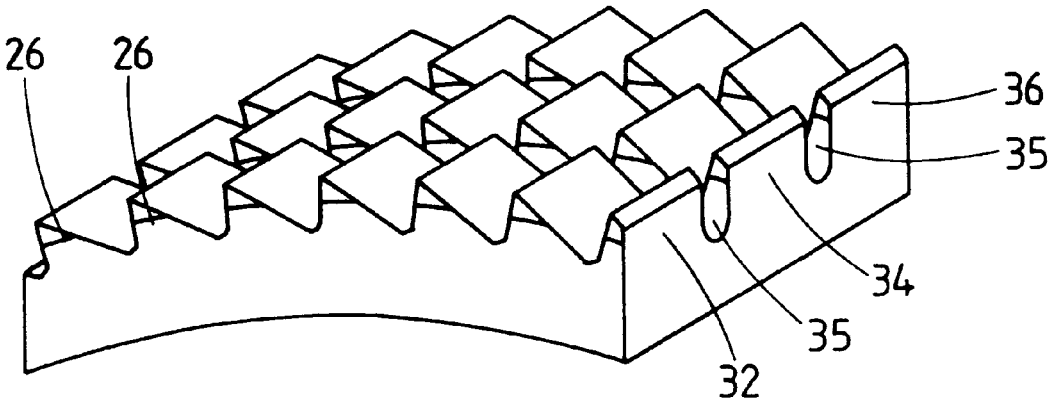
FIG. 6 is an isometric view illustrating a segment of the peripheral portion of the feed wheel of FIG. 4.

FIGS. 4, 5 and 6 illustrate the feed wheel 24 in more detail. In particular, this has teeth 26 arranged around the periphery thereof so as to facilitate frictional engagement with the wood piece 18, for driving thereof. In the illustrated embodiment, there are two axially spaced peripheral grooves 35 in the surface of the wheel so as to divide each tooth 26 into three tooth portions 32, 34, 36. There are thus three rows of such teeth portions arranged in the axial direction of the wheel, although the number of such rows may vary, as described later.

Figure 11:
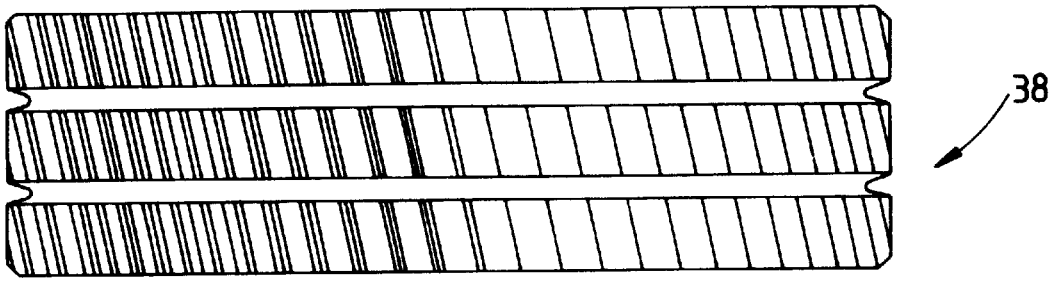
FIG. 11 is a top view of the rim portion of FIG. 10.
Figure 10:
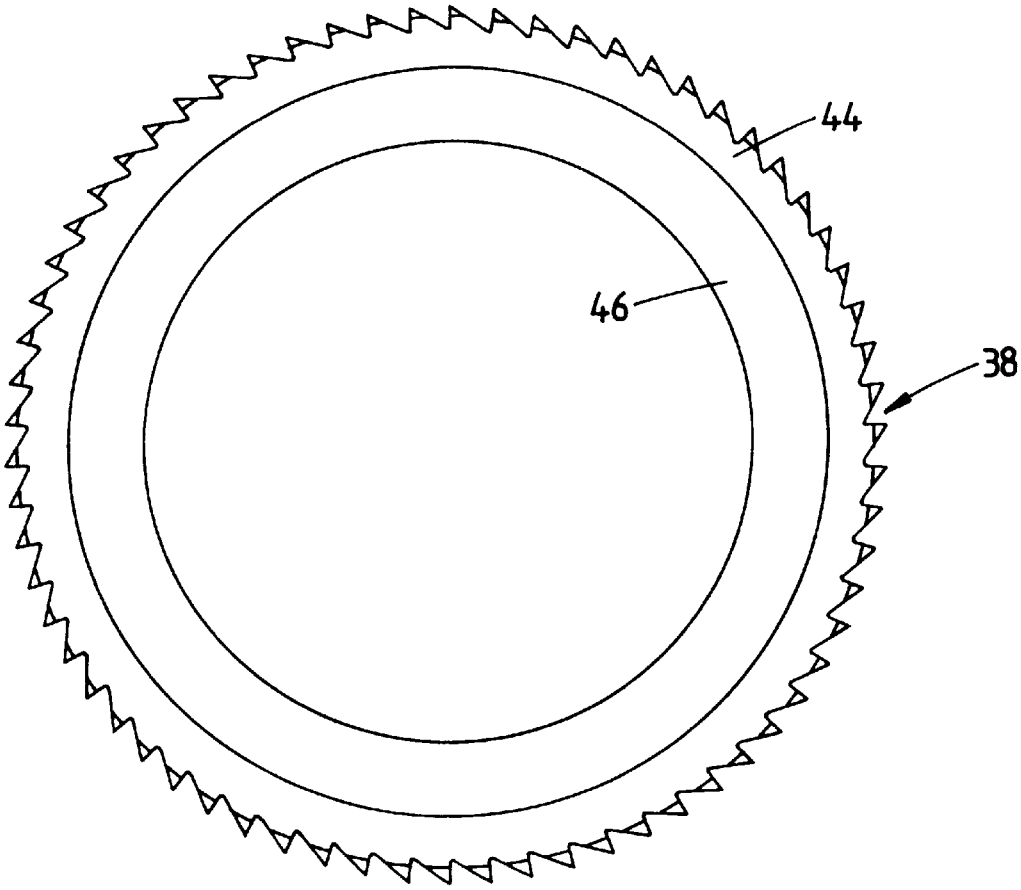
FIG. 10 is a side view of a rim portion forming part of a feed wheel in accordance with the embodiment of the invention.

In accordance with a specific aspect of the invention, the feed wheel 24 is formed in two parts, a rim part 38 and a hub part 40. The rim part 38 is shown in more detail in FIGS. 10 to 12. It carries the teeth 26 having portions 32, 34, 36 as abovementioned. The teeth 26 are formed on a generally hollow cylindrical outer portion 44 of the part 38, which portion 44 is integrally formed with an inner annular flange 46 to which the hub part 40 is bolted by bolts 47 (FIG. 4). The hub part 40 has an inner axial bore 50 with a keyway 52 such that the hub part can be neatly fitted over the shaft 22 and secured for rotation with respect thereto by insertion of a key (not shown) into the keyway 52 and into a corresponding keyway (also not shown) on the shaft 22. By this arrangement, when the teeth on the part 38 wear, it is possible to unbolt the part 38 from the part 40 and to replace it with a new part 38. By this, it is not necessary to replace the whole of the wheel 24 when tooth wear occurs, this resulting in a significant economy. That is to say, it is only necessary to discard part of the wheel 24 rather than the whole of it when wear occurs.

Figure 7:
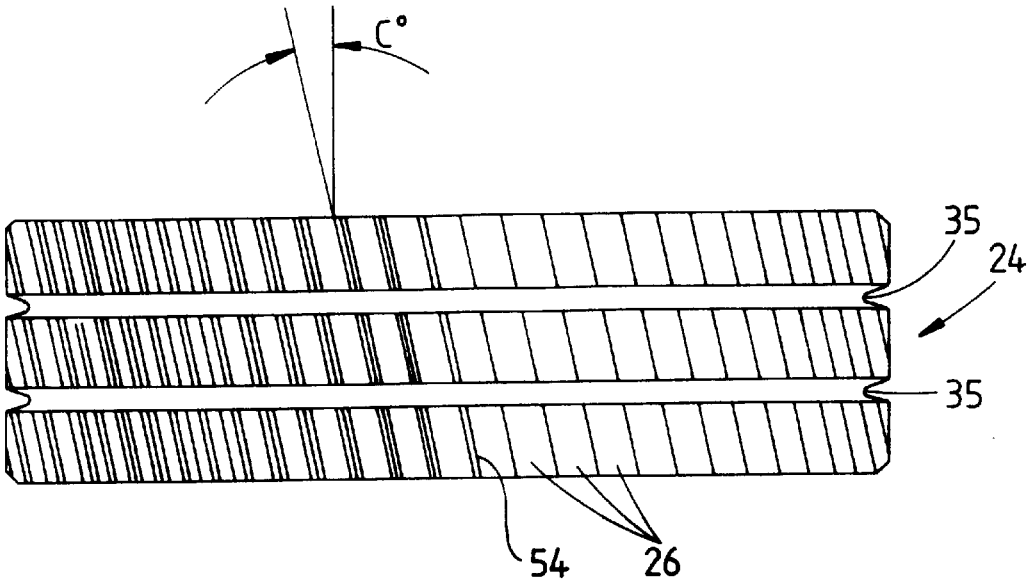
FIG. 7 is a view substantially the same as FIG. 5, but illustrating the helix angle of teeth on the periphery of the feed wheel.
Figure 8:
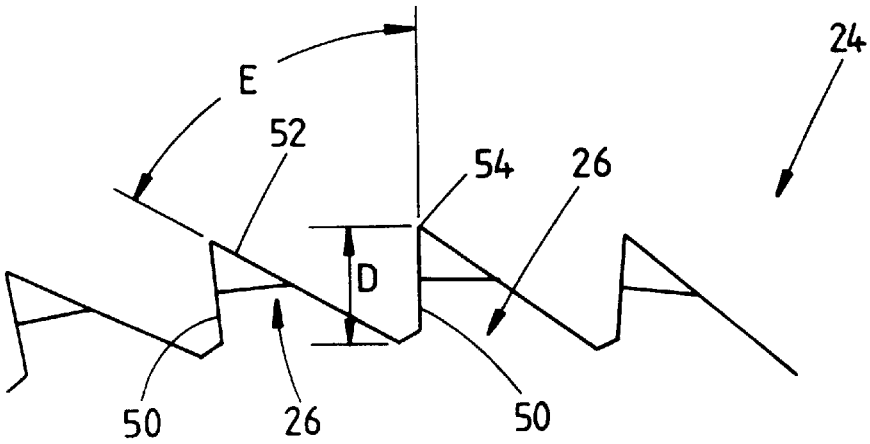
FIG. 8 is an enlarged side view of the teeth of the feed wheel of FIG. 4.

It is preferred that the teeth 26 of the wheel 24 be configured in the manner illustrated in FIGS. 7 and 8, in order to facilitate efficient driving of the wood piece. In particular, as shown in FIGS. 7 and 8, the teeth are generally of triangular form, having a generally radial leading face 50, and a trailing face 52 which is angularly disposed with respect to the respective face 50. The depth of the teeth, indicated as "D" in FIG. 8, is best selected to be in the range 4 to 7 mm, preferably substantially 5 mm. The selection of this dimension is related to the number of teeth that can be formed around the outside of the wheel. If the dimension "D" is increased, then there are less teeth around the outside of the wheel and less teeth in contact with the timber. If it is increased too far, slipping will occur as between the periphery of the wheel and the wood piece. If "D" is decreased, then there are more teeth around the wheel but the wheel is more likely to be clogged up with fibres from the wood and to stop functioning.

The teeth 26 are preferably arranged to such that apices 54 thereof are linear when viewed from the side of the wheel, and extend at a helix angle C as shown in FIG. 7 with respect to the axis of the wheel. It has been found that this angle is best selected to be between 15 and 25 degrees, usually substantially 20 degrees. The angle may be either positive or negative in value, reckoned with respect to the axis of the wheel. If the angle C is increased, then the wood piece tends to be forced harder towards the guide fence 14 and excessive wear of the fence and damage to the timber may occur. If the angle E is decreased, then the timber is not forced towards the fence, and poor machining of the timber is likely to result.

The angle E shown in FIG. 8, being the angle between the face 52 of each tooth 26 and the substantially radial face 50 of the next successive tooth around the periphery of the wheel, is best maintained within the range 58 to 62 degrees. If the angle is increased, longer wear life of the wheel is achieved, but the tooth may not grip the wood piece effectively. If the angle is decreased, the tooth may dig into the timber deeper and thus providing better gripping, but the tooth may wear out more quickly. It has been found that selecting the angle in the range 58 to 62 degrees as described provides a good compromise between wear and gripping.

In the illustrated embodiments so far described, the periphery of the wheel has two axially displaced grooves 35 so that the teeth 26 are interrupted in the axial direction of the wheel at these locations to form the respective tooth portions 32, 34, 36. It has been found that the provision of these grooves facilitates operation. The number of grooves may be selected in accordance with the type of timber being processed. It has been found, for example, to be satisfactory to provide three grooves for soft to medium hardness timber and five grooves for hard timber. FIG. 13 illustrates the case where there are four grooves, and thus each tooth has five tooth portions 132, 134, 136, 138 and 140.

Figure 9:
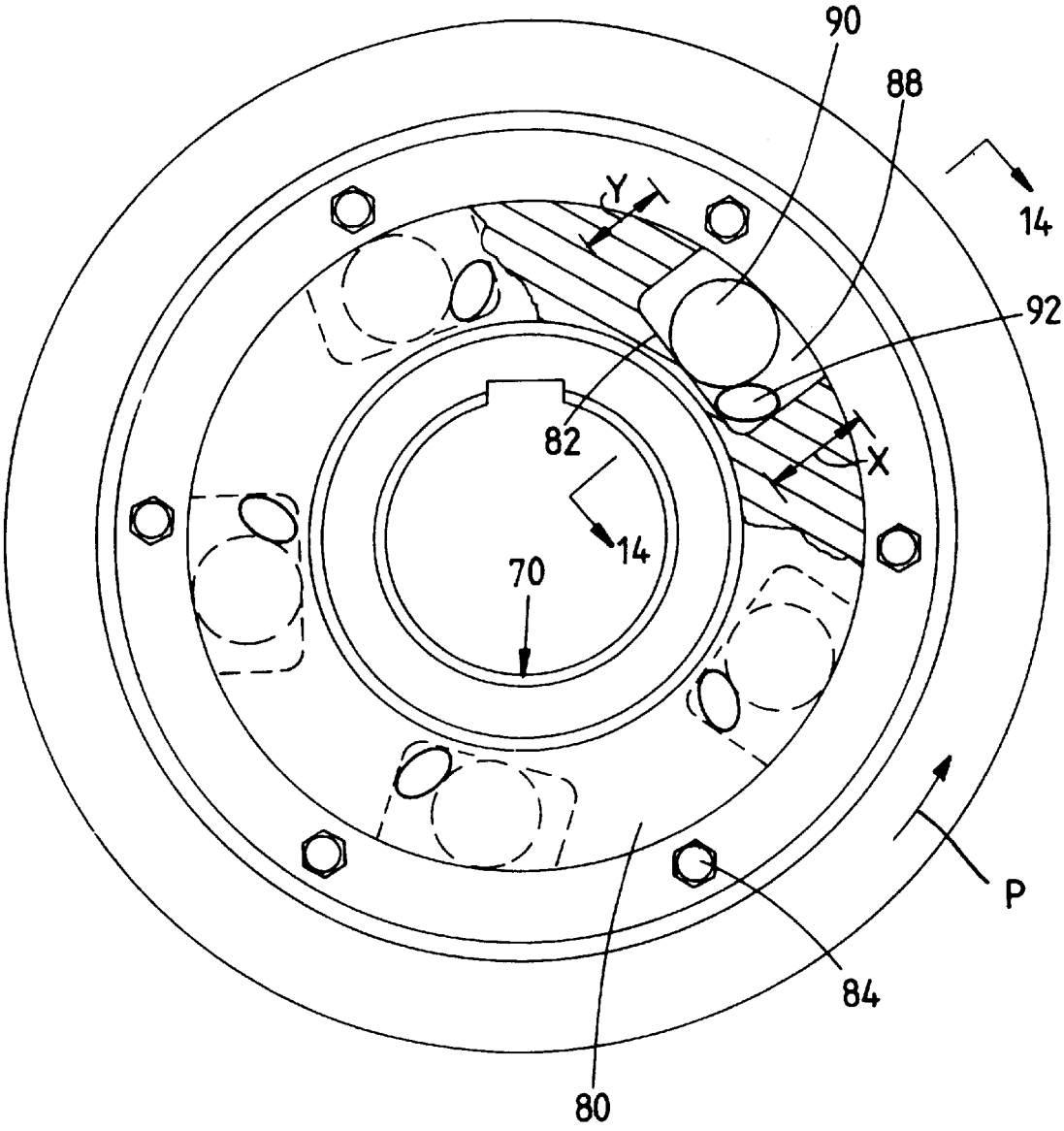
FIG. 9 is a partly sectioned side view of the feed wheel embodying a one-way clutch mechanism in accordance with the invention.
Figure 14:
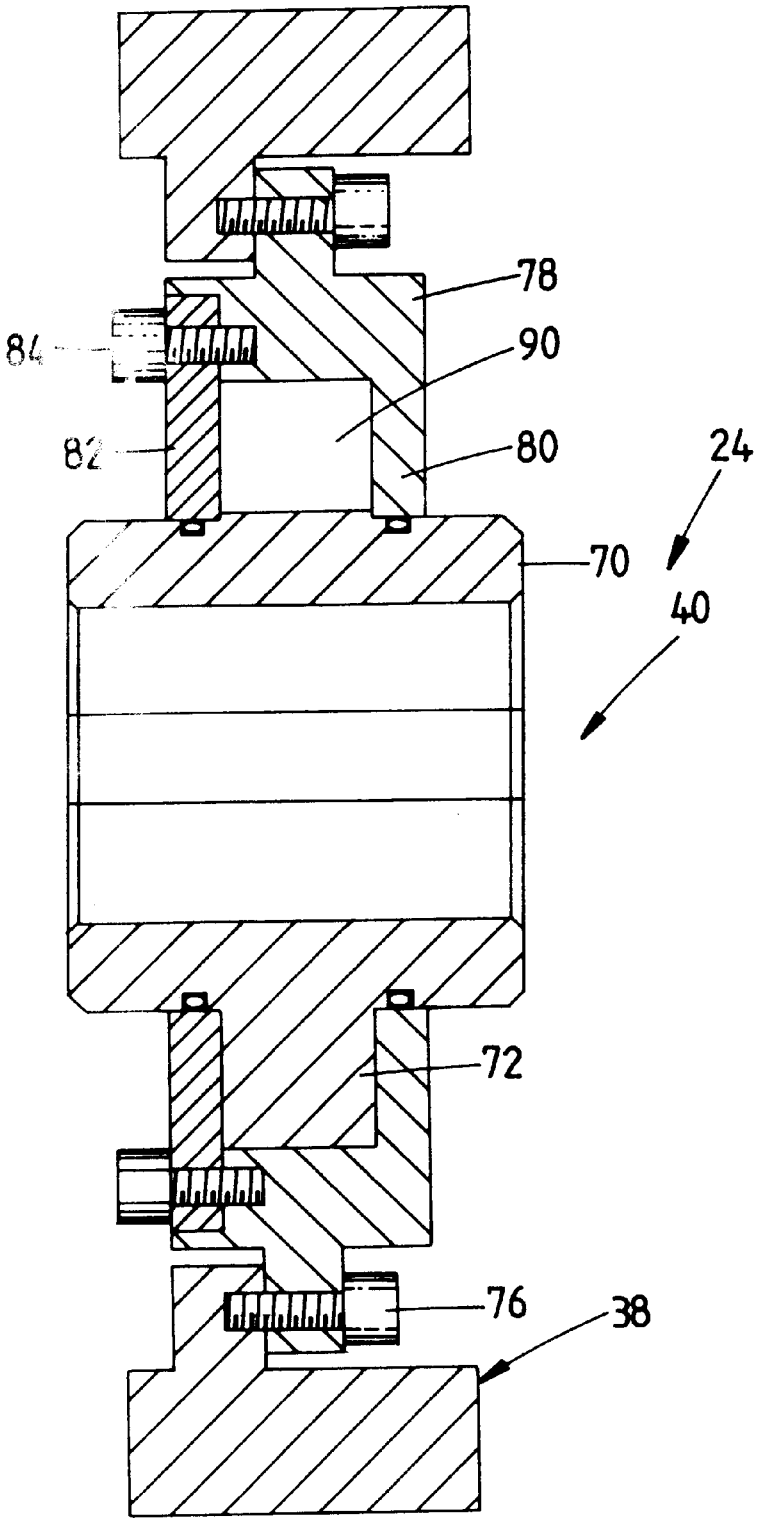
FIG. 14 is a cross-section substantially on the line 14—14 in FIG. 9.

Another problem which arises with use of the machines of the kind shown in FIGS. 1 to 3 is that of "gear drive wind up". In particular, the drive chain to the wheel may be subjected to intermittent or cyclic portional stress due to the timber work piece encountering intermittent or cyclic variations in the resistance to movement past the machine head 16. These variations may occur, for example, because of physical variations in the timber structure along its length, or to variations in the machining action of the head 16. If the feed wheel is an integral construction, keyed directly to the drive shaft 22, the torsional forces may be much as to cause failure of the drive motor or of any intervening components such as the gearbox 27. In order to alleviate this problem, it is possible, in accordance with the invention, to form the wheel 24 such that, while it can be driven in the direction required for feeding of the wood piece through the machine, it is freely rotatable in the reverse direction. FIGS. 9 and 14 illustrate a construction of this kind.

In FIGS. 9 and 14, the hub part 40 is shown as being formed from a central bearing element 70 having, intermediate its ends, a relatively wide outstanding angular flange 72. The ring 38 is bolted by bolts 76 to an annular member 78 having an inwardly projecting annular flange 80 at one axial side. The inner circular periphery of the flange 80 slidingly accommodates, and provides a bearing surface for, the outer periphery of the bearing portion 70. At an axial side of the wheel 24 opposite flange 80, an annular element 82 is bolted to the element 78 so as to extend in generally parallel spaced disposition with respect to the flange 80. Element 82 is bolted to the element 78 by means of bolts 84. The inner circular periphery of element 82 provides a second bearing surface for the bearing element 70. The flange 72 of the bearing element 70 is cut away at one axial side, at five peripheral locations, to form five pockets 88. These pockets are closed at the outer periphery thereof by the inner periphery of the element 78. Within each of the pockets 88 there is disposed a freely rotatable cylindrical element 90 the axes of these being parallel to that of the wheel 24. A base surface 82 of each pocket 88 extends such, within each pocket, the space between the surface 82 and the periphery of the element 78 increases in a circumferential direction around the axis of the wheel. That is to say, the pockets 88 have an approximately radial dimension "X" at one circumferential end which is greater than the corresponding dimension "Y" at the other circumferential end. The elements 90 are of such diameter that, in the case where the rim part 38 is rotated in the direction "P" shown in FIG. 9, relative to the hub part, the elements 90 tend to move towards the lesser dimensioned ("Y") end of the pockets 88 to be wedged between the surfaces 82 of the pockets and the inner periphery of the element 78, thus causing the hub part 40 and rim part 38 to be drivingly coupled together. On the other hand, under the condition of relative rotation of the rim part 38 in the direction opposite to the direction "P", with respect to the hub part 40, the elements 90 tend to be moved towards the greater dimension end ("X") end of the pockets 88. In consequence of which there is no coupling between the hub part 40 and rim part 38 and relatively free rotation may occur as between these.

In order to facilitate movement of the elements 90 in the pockets 88, a suitable resilient element 92 may be provided in each pocket 88 arranged to provide some resilient bias against the elements 90 in the direction towards the "Y" ends of the pockets 88.

Figure 15:
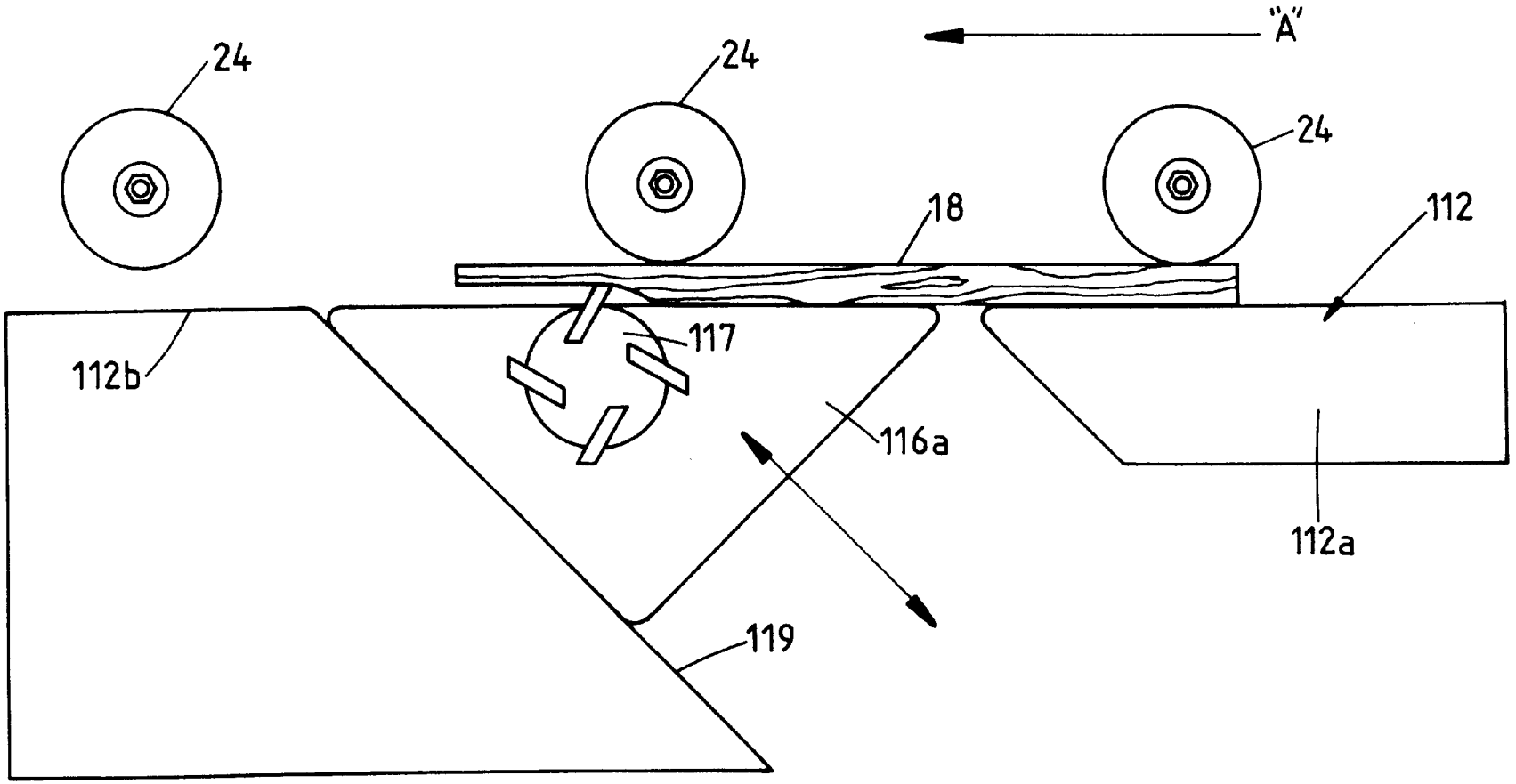
FIG. 15 is a diagrammatic side view of an alternative wood working machine constructed in accordance with the invention.

Feed wheels in accordance with the invention may be applied for use in machines of different form to that shown in FIG. 1 to 3. For example, FIG. 15 shows, in diagrammatic side section, an alternative machine 110, using feed wheels in accordance with the invention. Here, the bed 112 is formed in two parts 112*a*, 112*b*, between which is positioned a cutter head 116*a*, having mounted thereon a cutter 177, the cutter head being slidable on an inclined surface 119 so as to enable it to be vertically moved to vary the extent to which the cutter 117 projects above the bed 112. In this case several feed wheels 24 are provided to feed the wood piece 18 along the bed, to be cut from the underside by the cutter 117. In this case, the wheels 24 are arranged at pre-fixed locations.

Figure 16A:
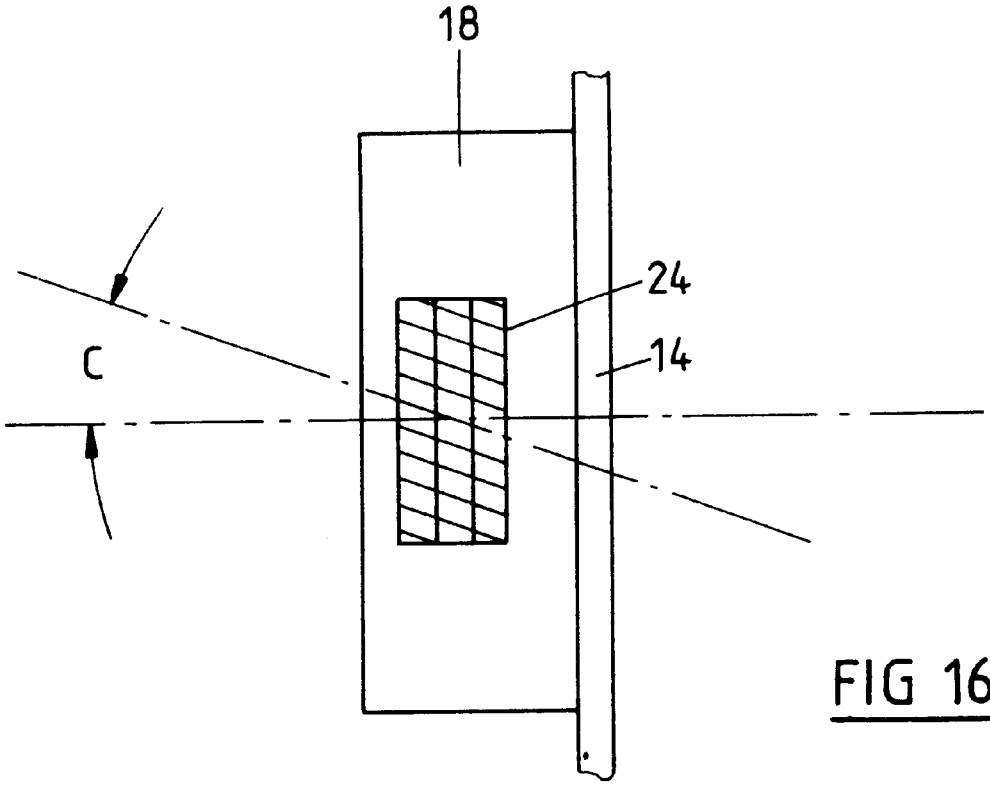
FIGS. 16(*a*) and 16(*b*) illustrate arrangements of a feed wheel of the invention, for feeding wood pieces guided by a fence, for conditions where the fence is positioned at right-hand left-hand sides of the wood piece respectively.
Figure 16B:
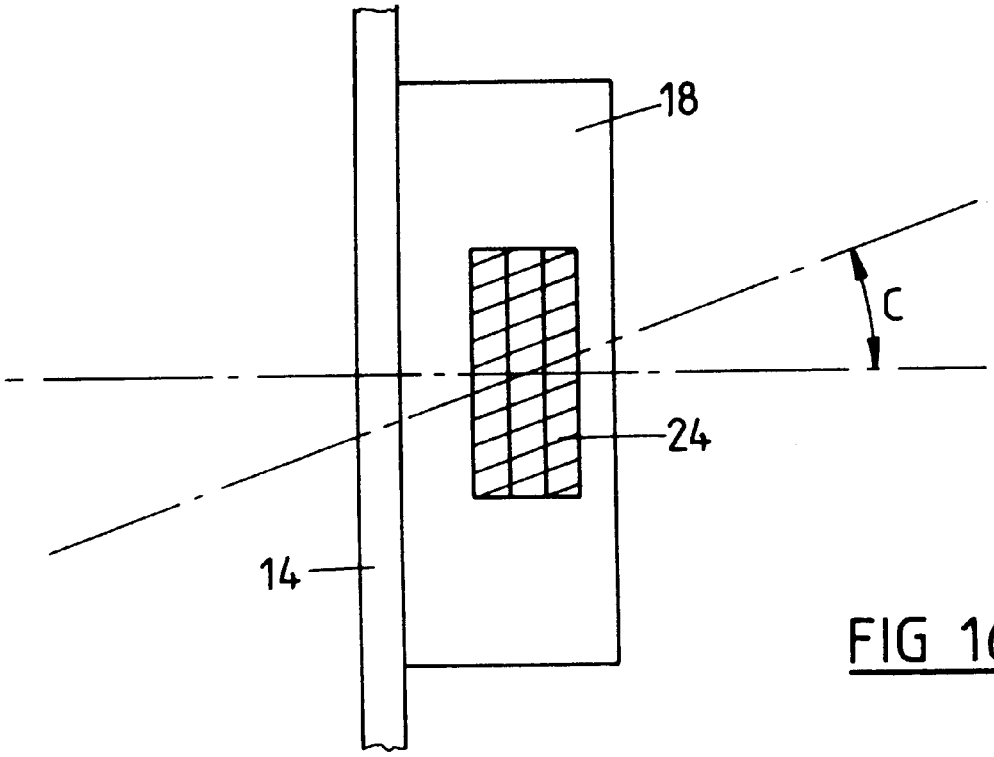

Further, the wheels may be arranged such that the helix angle "C", which is either positive or negative with respect to the axis of the wheel 24, is utilised such that the wood piece 18 is, generally, urged towards the fence 14 during its movement through the machine 10, or 110. In particular, the apices of the teeth 26, at the axis of the wheel as viewed from directly above the wheel axis, are disposed so that the ends of the apices at the side of the wheel away from the fence 14 are further advanced in the feed direction than the ends at the side of the wheel closest the fence. This is illustrated diagrammatically in FIGS. 16(*a*) and 16(*b*) for cases where the fence 14 is to the right and to the left of the wheel, viewed from above.

The wheels may also be provided with a wear-resistant surface such as a wear-resistant hard chromed or diamond layer applied to the teeth to increase the working life of each wheel. In the case of a diamond wear-resistant layer, in particular, the following procedure may be adopted. Firstly, the teeth need to be formed of a magnetic material such as steel. The surface of the teeth needs to be chemically cleaned and etched to remove all traces of oil and foreign matter. The rim part 38 is then immersed in a nickel compound chemical solution, which includes diamond grit, such that a metallic nickel compound is deposited on the surface of the teeth. The diamond grit is simultaneously deposited by method of attraction to thereby form the wear-resistant layer. The metallic nickel compound can be precipitation hardened, if required.

While the invention has been described specifically in relation to the working of wood pieces, it can be applied to the working of any work piece having properties which facilitate feeding by use of wheels of the kind described. For example, it may be applied to work pieces capable of being driven by toothed wheels, such as work pieces formed of plastics.

The described construction has been advanced merely by way of explanation, and many modifications and variations may be made thereto without departing from the spirit and scope of the invention which includes every novel feature and combination of novel features herein disclosed.

What is claimed is:

1. A feed wheel for use in a wood working machine in which the feed wheel is rotated while in driving engagement with the surface of a wood piece to drive the wood piece past a wood working element, for working the wood piece, said wheel defining a periphery configured to establish a driving engagement with the wood piece, and said wheel having a one way drive device such that the feed wheel may be driven only in a direction for feeding the wood piece, said drive enabling the wheel to freely rotate in a direction opposite that for feeding.

2. A feed wheel for use in a wood working machine in which the feed wheel is rotated while in driving engagement with the surface of a wood piece to drive the wood piece past a wood working element, for working the wood piece, said wheel defining a periphery configured to establish a driving engagement with the wood piece, said feed wheel having a rim portion separable from a remainder thereof.

3. A feed wheel for use in a wood working machine in which the feed wheel is rotated while in driving engagement with the surface of a wood piece to drive the wood piece past a wood working element, for working the wood piece, said wheel defining a periphery configured to establish a driving engagement with the wood piece, said feed wheel having teeth around a circumference thereof, the teeth presenting a forward substantially radial face, and a trailing face which extends at an angle to the substantially radial face, such that the teeth are generally triangular in cross-section, the teeth being arranged such that apices thereof, defined at a junction between the faces thereof, extend at a helix angle relative to an axis of the wheel.

4. A feed wheel as claimed 3, wherein the angle of the apices of the teeth relative to the axis of the wheel is in the range of 15 to 25 degrees.

5. A feed wheel as claimed in claim 4, wherein the angle is substantially 20 degrees.

6. A feed wheel as claimed in claim 3, wherein an angle presented between the trailing face of each tooth, and the substantially upright face of a succeeding tooth is in the range 58 to 62 degrees.

7. A feed wheel as claimed in claim 3, wherein the substantially radial face of each tooth reckoned radially of the wheel is within the range of 4 to 7 mm.

8. A feed wheel as claimed in claim 3, wherein the teeth have one or more circumferential grooves.

9. A feed wheel as claimed in claim 3, wherein the teeth are formed on a rim portion of the wheel which is separable from the remainder thereof.

10. A feed wheel as claimed in claim 3, wherein the wheel incorporates a one way drive device such that the feed wheel may be driven only in the direction for feeding the wood piece and is freely rotatable in the direction opposite to that for feeding.

11. A feed wheel as claimed in claim 3, wherein the teeth are provided with a wear-resistant surface for engaging the wood piece.

12. A feed wheel as claimed in claim 11, wherein the surface is formed of a wear-resistant diamond layer.

13. A feed wheel as claimed in claim 11, wherein the surface is in the form of a hard-chromed layer.

14. A wood working machine including a feed wheel as claimed in claim 1.

15. A wood working machine including a feed wheel as claimed in claim 2.

16. A wood working machine including a feed wheel as claimed in claim 3.

* * * * *